US007414200B2

(12) United States Patent
Strauser

(10) Patent No.: US 7,414,200 B2
(45) Date of Patent: Aug. 19, 2008

(54) THREE-WAY CABLE ARRANGEMENT FOR KARAOKE DEVICES AND THE LIKE

(75) Inventor: Jack Strauser, Pinellas Park, FL (US)

(73) Assignee: J. S. Karaoke, LLC, Largo, FL (US)

( * ) Notice: Subject to any disclaimer, the term of this patent is extended or adjusted under 35 U.S.C. 154(b) by 86 days.

(21) Appl. No.: 11/672,753

(22) Filed: Feb. 8, 2007

(65) Prior Publication Data

US 2008/0053683 A1 Mar. 6, 2008

Related U.S. Application Data

(63) Continuation-in-part of application No. 11/469,654, filed on Sep. 1, 2006.

(51) Int. Cl.
*H01B 7/00* (2006.01)

(52) U.S. Cl. ..... 174/113 R; 174/72 R

(58) Field of Classification Search ..... 174/113 R, 174/71 R, 72 R, 72 A; 725/81
See application file for complete search history.

(56) References Cited

U.S. PATENT DOCUMENTS

| | | | | |
|---|---|---|---|---|
| 5,951,302 | A | 9/1999 | Decker, Jr. | |
| 6,025,553 | A | 2/2000 | Lee | |
| 6,520,776 | B1 | 2/2003 | Kurukawa | |
| 6,563,038 | B2 | 5/2003 | Kikuchi | |
| 6,851,952 | B2 | 2/2005 | Ueshima et al. | |
| 2006/0288388 | A1 * | 12/2006 | Harris et al. | 725/81 |

* cited by examiner

*Primary Examiner*—Chau N Nguyen
(74) *Attorney, Agent, or Firm*—Larson & Larson; Frank Liebenow

(57) ABSTRACT

A karaoke device is included within an enclosure and having a voice pickup element integrated into the enclosure for converting sound waves into an electrical signal. An audio input signal from a DVD player passes into the enclosure and into an electronic circuit for amplifying the electrical signal, for controlling the amplitude of the electrical signal and for mixing the electrical signal and the audio input signal into a mixed audio signal. The resulting audio output signal is delivered to an output device such as a television.

19 Claims, 3 Drawing Sheets

THREE-WAY CABLE ARRANGEMENT FOR KARAOKE DEVICES AND THE LIKE

RELATED APPLICATIONS

This application is a continuation-in-part of co-pending application Ser. No. 11/469,654 filed Sep. 1, 2006.

BACKGROUND OF THE INVENTION

1. Field of the Invention

This invention relates to a cable arrangement and more particularly to a three-way cable arrangement for connecting a music/video source to a karaoke system and a television.

2. Description of the Related Art

Cable arrangements are well known in the industry. Most cable arrangements are point-to-point, connecting two devices. Some cable arrangements are three-way, often called a Y-connector. These arrangements connect one or more input connectors from a source to the same output connectors for multiple sink devices. For example, a stereo audio Y-cable arrangement can connect the audio outputs of a DVD player to both the inputs of an amplifier and the inputs of a VCR, simultaneously.

Likewise, karaoke devices are well known in the industry. Generally, these devices include a source of music and lyrics that are played/displayed while the user(s) sing along. Early karaoke devices included a magnetic tape or compact disc with music recorded thereon. The music recorded is without vocal sound track or the vocal track is significantly muted so that the user can sing along with the music.

A professional karaoke system includes a source of music and lyrics, one or more microphones, a sound processing/amplification system for enhancing the user's voice and a display system for displaying lyrics and cues for the user(s). Some sound processing and amplification systems includes circuitry for adding echo to the user's voice and possibly additional circuitry to enhance the user's voice. It may also include a mixer for mixing the sound track with the user's voice. The display system is for displaying video information about the music, lyrics and a cue (e.g., color changes of lyrics) to help keep the user's singing on track with the music.

Home karaoke players have become popular in recent years. These systems include a player that accepts a microphone input and a karaoke disc or tape and mixes the user's voice with music from the disc, amplifies the sound and reproduces the sound with a speaker. One such system is described in U.S. Pat. No. 5,951,302 to Decker. There are several drawbacks to karaoke systems as described. The first drawback relates to having a separate device that duplicates many of the functions that are already performed by other components often found in homes and business. Many users already have a device that is capable of playing karaoke tapes or disks; for example, a CD player or DVD player. These users often have another device for amplifying and reproducing the music; for example, a stereo system or television. These users often have a device for displaying the lyrics and cues; for example, a television. Therefore, having another device that replicates many of these functions is wasteful and increases clutter. Another drawback to these types of systems is that the controls are often on the device, not the microphone. Being such, the user must approach the device with the microphone to adjust the volume, echo, etc, often causing undesirable feedback and noise. A third drawback is the requirement for a wire from the microphone to the karaoke device.

Recently, music players and music/video players have reached the market, often called MP3 players or "iPods." One such player is the SanDisk Sansa® View Pocket Video Player. This player has audio and video outputs on a single, 4-conductor 3.5 mm headphone jack. Another such player is the iPod from Apple, Inc. The iPod also has audio and video outputs on a single, 4-conductor 3.5 mm headphone jack. Such music players are capable of storing and playing karaoke content.

In example of a cable assembly is shown in U.S. Pat. No. 7,070,445 to Shah, et al. The described cable assembly is designed for connecting high-speed Serial Advanced Technology Attachment devices and does not have facilities for analog audio and video signals.

Another example of a cable assembly is shown in U.S. Pat. No. 7,134,908 to Wu. The described cable assembly is designed to provide communications between electronic equipment and does not have facilities for analog audio and video signals.

Another example of a cable assembly is shown in U.S. Pat. No. 6,583,360 to Yudashkin. The described cable assembly is designed to conduct audio signals but does not have facilities for video signals nor does it have three-way cababilities.

What is needed is a three-way cable assembly that interfaces with music/video sources, karaoke devices and display devices.

SUMMARY OF THE INVENTION

In one embodiment, a three-way cable assembly is disclose with a first connector for connecting to an audio/video source and an input cable with audio input conductors and video input conductors connected to the first connector. An intermediate audio cable has a first set and a second set of audio conductors, the first set of audio conductors are connected to the audio conductors of the input cable. An output cable has output audio conductors; the output audio conductors are connected to the second set of audio conductors of the intermediate connector. The output cable also has video output conductors that connect to the video input conductors.

In another embodiment, three-way cable assembly is disclose including a 3.5 mm phone plug for connecting to an audio/video source and having contacts for left-audio, right-audio, video and ground. An input cable interfaces at one end to the 3.5 mm phone plug and has left audio input conductors connected to the 3.5 mm phone plug left-audio, right audio input conductors connected to the 3.5 mm phone plug right-audio, video input conductors connected to the 3.5 mm phone plug video and a ground conductor connected to the 3.5 mm phone plug ground. An intermediate audio cable has first left and right audio conductor and second left and right audio conductor and an intermediate ground, the first left audio conductors connected to the left audio conductors of the input cable and the first right audio conductors connected to the right audio conductors of the input cable. The intermediate ground is connected to the ground conductor of the input cable. An output cable with an output left audio conductor, an output right audio conductors, an output video conductor and an output ground has its output left audio conductors connected to the second left audio conductor of the intermediate connector, the output right audio conductors connected to the second right audio conductor of the intermediate connector, the video output conductor connected to the video input conductor, and the output ground connected to the input ground and the intermediate ground.

In another embodiment, a three-way cable assembly is disclosed with a device for connecting to an audio/video source. An input cable with audio input conductors and video input conductors is connected to the device for connecting. An intermediate audio cable with a first set and a second set of audio conductors is provided, the first set of audio conductors are connected to the audio conductors of the input cable. An output cable with output audio conductors is also provided; the output audio conductors are connected to the second set of audio conductors of the intermediate connector. The output cable also has video output conductors connected to the video input conductors and there is a way to physically join the input cable, the output cable and the intermediate cable.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
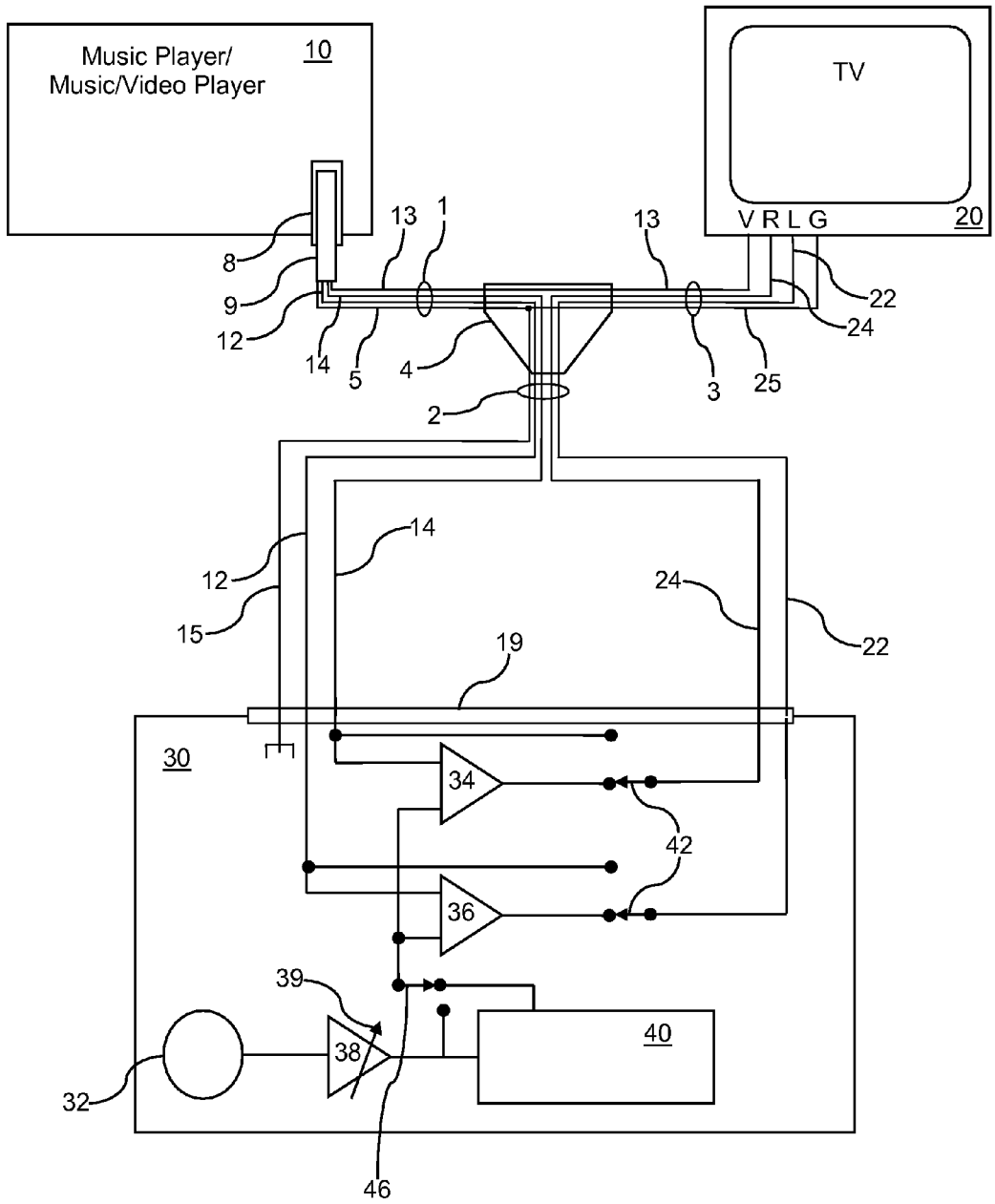
FIG. 1 illustrates a block diagram of the present invention used with a first karaoke system.

Reference will now be made in detail to the presently preferred embodiments of the invention, examples of which are illustrated in the accompanying drawings. Throughout the following detailed description, the same reference numerals refer to the same elements in all figures. In the following description, a music/video player is used as an example of a source of karaoke content (e.g., music with suppressed vocal tracks, lyrics and video) and a television or TV is used as an example of an output device that includes sound amplification and reproduction as well as video display. There are many other sources of karaoke content that can utilize the cable arrangement of the present invention such as personal computers, CD players, tape players, laser disc players, video cameras and MP3 players. The present invention is not limited in any way to its source of audio/video content. There are many other output devices that include sound amplification and reproduction as well as a display, either in an integrated package or in individual components. Examples of such are stereo systems, monitors, personal computers, etc.

For simplicity, the block diagrams exclude a source of operating power. Power supplies including batteries and transformers are well known in the industry.

Referring to FIG. 1, a block diagram of the present invention is shown connected to a portable music/video player 10, a television 20 and a karaoke device 30. In this example, a music/video player 10 has an output connector 8, such as the 3.5 mm audio/video phone jack connector used in several audio/video players. A mating 3.5 mm phone plug 9 is inserted into the output connector 8 making contact with the video signal conductor 13, the left 12 and right 14 audio signal conductors and a ground conductor 5, which are routed in input cable 1 to a cable head 4. The ground conductor is connected to a ground conductor 25 that passes out of the cable head 4 in the output cable 3 to the television 20. The ground conductor is also connected to a ground conductor 15 that passes out of the cable head 4 in the intermediate cable 2, and is connected to the karaoke device 30 with a connector 19. The video signal 13 passes through the input cable 1, through the cable head 4 and through the output cable 3 to the video input of a television 20. The left 12 and right 14 audio outputs from the music/video player 10 passes through the input cable 1, through the cable head 4 and out through an intermediate cable 2 and is connected to the karaoke device 30 with a connector 19. The left 22 and right 24 audio outputs from the karaoke device pass through the connector 19, through the intermediate cable 2, through the cable head 4 and through the output cable 3 to the television 20. The wires of the output cable 3 are preferably terminated with RCA phono plugs being that most standard televisions accept audio and video signals using RCA phono jacks. Although the cable assembly of the present invention is preferably used in conjunction with a karaoke device 30 that is hand-held and preferably shaped similar to a standard microphone, the intermediate cable works equally well with other karaoke devices or other audio processing devices.

In the embodiment where the cable arrangement of the present invention interfaces to a hand-held karaoke device, the hand-held karaoke device 30 has a voice pick-up element 32 situated on an outer surface in a location where it can receive sound waves corresponding to the user's voice. The voice pick-up element converts the sound waves into an electrical signal that is connected to an amplifier 38 that adjustably 39 amplifies the user's voice to a level compatible with the audio outputs 12/14 from the music/video player 10. In the preferred embodiment, the amplifier's output is adjusted by a multi-position switch connected to a resistor ladder. In other embodiments, the amplifier's output is adjusted with a potentiometer or a digital potentiometer having a volume-up and a volume-down push button switch. For most music/video player, the audio output level is usually around 1 volt, peak-to-peak. The audio output signal from the adjustable amplifier 38 interfaces to a selector switch 46 and a sound processor 40. The sound processor 40 enhances the user's voice by adding, for example, echo. The selector switch 46 lets the user select either audio from the voice pick-up element 32 or from the sound processor 40. In some embodiments, the selector switch is integrated into an on/off power switch (not shown) having three positions such as off, on and on/echo.

The audio output from the selector switch is mixed with the left input 12 by amplifier 36 producing a mixed left audio signal and with the right input 14 by amplifier 34 producing a mixed right audio signal. The outputs of the amplifiers 34/36 pass to another selector switch 42 that selects to either pass the left 12 and right 14 audio from the music/video player 10 directly to the outputs 22/24 or pass the mixed audio to the outputs 22/24.

Figure 2:
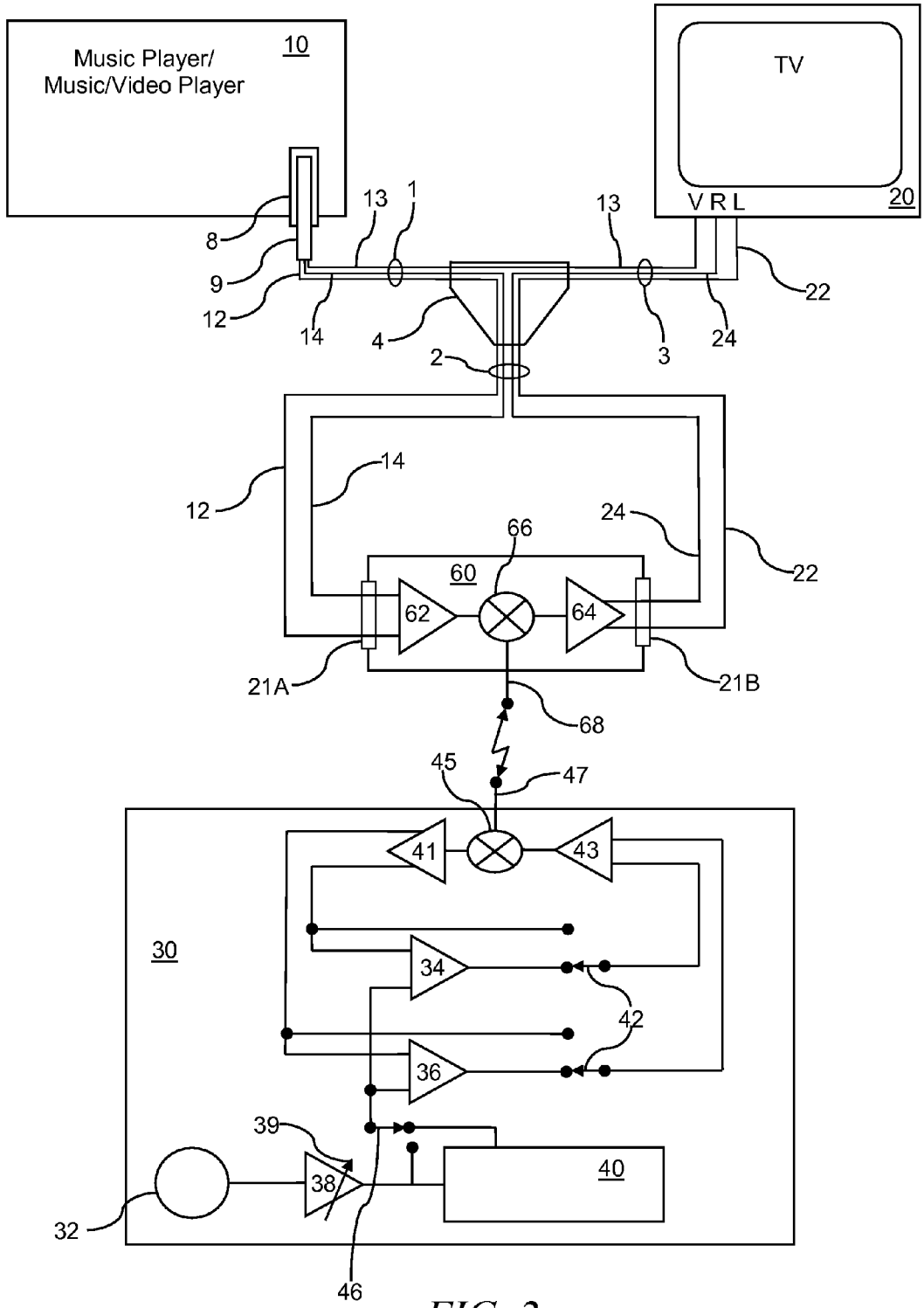
FIG. 2 illustrates a block diagram of the present invention used with a second karaoke system.

Referring to FIG. 2 a block diagram of the present invention is shown connected to a portable music/video player 10, a television 20 and a wireless karaoke device 30/30. As in the prior example, a music/video player 10 has an output connector 8, such as the 3.5 mm audio/video phone jack connector used in several audio/video players. A mating 3.5 mm phone plug 9 is inserted into the output connector 8 making contact with the video signal 13 and the left 12 and right 14 audio signals, which are routed in input cable 1 to a cable head 4. The video signal 13 passes through the input cable 1, through the cable head 4 and through the output cable 3 to the video input of a television 20. The left 12 and right 14 audio outputs from the music/video player 10 passes through the input cable 1, through the cable head 4 and out through an intermediate cable 2 and is connected to the karaoke device 60 with a connector 21A/21B (one single connector shown split for clarity purposes). The left 22 and right 24 audio outputs from the karaoke device pass through the connector 19, through the intermediate cable 2, through the cable head 4 and through the output cable 3 to the television 20. The wires of the output cable 3 are preferably terminated with RCA phono plugs being that most standard televisions accept audio and video signals using RCA phono jacks. In this example, the cable assembly of the present invention is used in conjunction with a wireless transmitter 60 that is wirelessly interfaced to a hand-held karaoke device 30. The audio transceiver 60 has a modulator 62 (either analog or digital modulation) that modulates the left and right audio onto a wireless carrier such as a radio frequency or an infrared light frequency. Many methods of modulation such as Amplitude Modulation (AM), Frequency Modulation (FM) and Quadrature Modulation (QAM) are known in the industry and any can be used without veering from the present invention. In the example shown, the audio signals are modulated onto an RF signal that passes through an antenna mixer 66 to an antenna 68 where the modulated RF signal radiates and is picked up by an antenna 47 on the karaoke device 30.

The karaoke device 30 is hand-held and preferably shaped similar to a standard microphone. The modulated audio signal from the antenna 47 passes through an antenna mixer 45 and is demodulated by a demodulator 41 into left and right audio signals representative of the left and right audio signals from the music/video player 10. A voice pick-up element 32 is situated on an outer surface of the karaoke device 30 in a location where it can receive sound waves corresponding to the user's voice. The voice pick-up element is connected to an amplifier 38 that adjustably 39 amplifies the user's voice to a level compatible with the audio outputs 12/14 from the demodulator 41. In the preferred embodiment, the amplifier's output is adjusted by a multi-position switch connected to a resistor ladder. In other embodiments, the amplifier's output is adjusted with a potentiometer or a digital potentiometer having a volume-up and a volume-down push button switch. For most music/video players, the audio output level is usually around 1 volt, peak-to-peak.

The audio output signal from the adjustable amplifier 38 interfaces to a selector switch 46 and a sound processor 40. The sound processor 40 enhances the user's voice by adding, for example, echo. The selector switch 46 lets the user select either audio directly from the voice pick-up element 32 or from the sound processor 40. In some embodiments, the selector switch is integrated into an on/off power switch (not shown) having three positions such as off, on and on/echo.

The audio output from the selector switch is mixed with the left input by amplifier 36 and with the right input by amplifier 34. The outputs of the amplifiers 34/36 pass to another selector switch 42 that selects to either pass the left and right audio from the music/video player 10 to the outputs or pass the mixed audio to the outputs. The outputs of the karaoke device 30 are modulated in a similar way to the modulator in the audio transceiver 60 modulator 62 by another modulator 43. The modulated signal passes through the antenna mixer 45 and is radiated by the antenna 47. The radiated modulated audio signals are received by the audio transceiver's 60 antenna 68 and pass through the antenna mixer 66 and are demodulated by a demodulator 64. The audio output 22/24 of the demodulator 64 passes in the intermediate cable 2 through the cable head 4 and through the output cable 3 to the television 20. Again, it is preferred to have RCA phono jacks on the end of the wires of output cable 3 for compatibility with most televisions.

Figure 3:
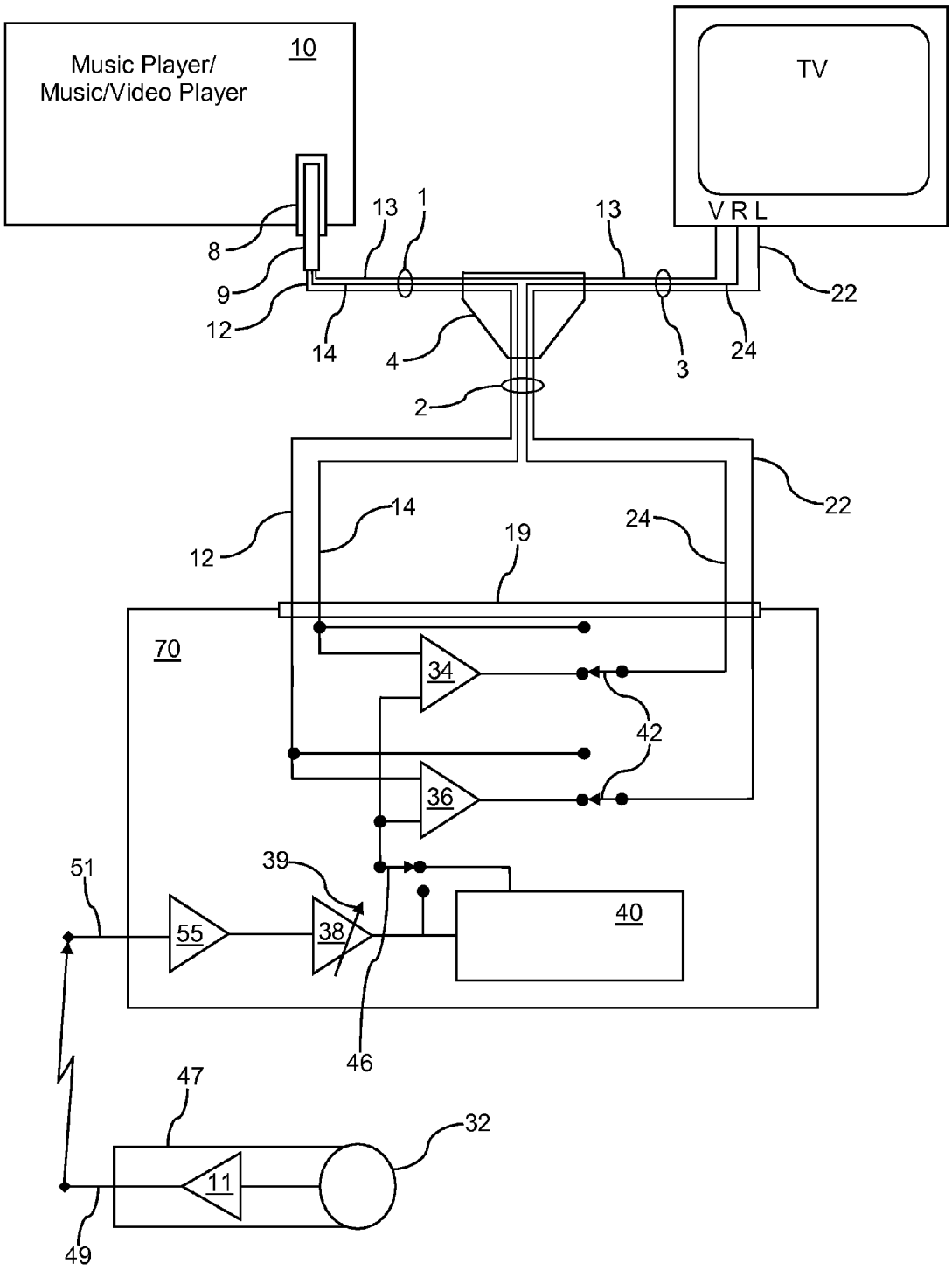
FIG. 3 illustrates a block diagram of the present invention used with a third karaoke system.

Referring to FIG. 3, a block diagram of the present invention is shown connected to a portable music/video player 10, a television 20 and a different karaoke device 70. In this example, a music/video player 10 has an output connector 8, such as the 3.5 mm audio/video phone jack connector used in several audio/video players. A mating 3.5 mm phone plug 9 is inserted into the output connector 8 making contact with the video signal 13 and the left 12 and right 14 audio signals, which are routed in input cable 1 to a cable head 4. The video signal 13 passes through the input cable 1, through the cable head 4 and through the output cable 3 to the video input of a television 20. The left 12 and right 14 audio outputs from the music/video player 10 passes through the input cable 1, through the cable head 4 and out through an intermediate cable 2 and is connected to the karaoke device 70 with a connector 19. The left 22 and right 24 audio outputs from the karaoke device 70 pass through the connector 19, through the intermediate cable 2, through the cable head 4 and through the output cable 3 to the television 20. The wires of the output cable 3 are preferably terminated with RCA phono plugs being that most standard televisions accept audio and video signals using RCA phono jacks. Although the cable assembly of the present invention is preferably used in conjunction with a karaoke device 70 that includes a wireless microphone, the intermediate cable works equally well with other karaoke devices or other audio processing devices.

In this embodiment, the cable arrangement of the present invention interfaces to a karaoke device 70 that has a wireless microphone 47. A voice pick-up element 32 is situated on an outer surface of a wireless microphone 47 in a location where it can receive sound waves corresponding to the user's voice. The voice pick-up element converts the sound waves into an electrical signal that is connected to an amplifier and modulator 11 that amplifies the user's voice and modulates the audio signal onto a wireless signal (e.g., Radio Frequency or Infrared), emitting the wireless signal on an external antenna 49 or IR transducer (not shown). As discussed previously, any known method of modulation can be used to wirelessly send the user's voice (audio) to the base station karaoke device 70.

The wireless signal is picked up by a matching antenna (or IR transducer) 51 at the base station karaoke device 70 and demodulated by a demodulator 55 producing an electrical audio signal similar to the user's voice. This electrical signal is amplified by an amplifier 38 with volume control 39 to a level compatible with the audio outputs 12/14 from the music/video player 10. In the preferred embodiment, the amplifier's output (volume) is adjusted by a multi-position switch connected to a resistor ladder. In other embodiments, the amplifier's output is adjusted with a potentiometer or a digital potentiometer having a volume-up and a volume-down push button switch. For most DVD players, the audio output level is usually around 1 volt, peak-to-peak.

The audio output signal from the adjustable amplifier 38 interfaces to a selector switch 46 and a sound processor 40. The sound processor 40 enhances the user's voice by adding, for example, echo. The selector switch 46 lets the user select either audio from the voice pick-up element 32 or from the sound processor 40. In some embodiments, the selector switch is integrated into an on/off power switch (not shown) having three positions such as off, on and on/echo.

The audio output from the selector switch is mixed with the left input 12 by an amplifier 36 and with the right input 14 by amplifier 34. The outputs of the amplifiers 34/36 pass to another selector switch 42 that selects to either pass the left 12 and right 14 audio from the music/video player 10 directly to the outputs or pass the mixed audio to the outputs. The outputs of the base station karaoke device 70 passes in the intermediate cable 2 through the cable head 4 and through the output cable 3 to the television 20. Again, it is preferred to have RCA phono jacks on the end of the wires of output cable 3 for compatibility with most televisions.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A three-way cable assembly comprising:

a first connector for connecting to an audio/video source;

an input cable having audio input conductors and a video input conductor connected at a first end to the first connector;

an intermediate audio cable having a first set of intermediate audio conductors and a second set of intermediate audio conductors, first ends of the first set of intermediate audio conductors connected to second ends of the audio input conductors of the input cable; and an output cable having audio output conductors and a video output conductor, second ends of the audio output conductors connected to first ends of the second set of intermediate audio conductors of the intermediate audio cable, a second end of the video output conductor connected to a second end of the video input conductor.

2. The three-way cable assembly of claim 1, wherein the first connector is a 3.5 mm phone plug with contacts for left-audio, right-audio, video and ground.

3. The three-way cable assembly of claim 1, wherein the input cable, intermediate cable and output cable meet at a cable head.

4. The three-way cable assembly of claim 1, further comprising two RCA phono plugs, each electrically and physically interfaced with first ends of the audio output conductors of the output cable and a video RCA phono plug electrically and physically interfaced with a first end of the video output conductor of the output cable.

5. The three-way cable assembly of claim 1, wherein the intermediate audio cable is terminated with a second connector having contacts for each of the first set of audio conductors and for each of the second set of audio conductors.

6. The three-way cable assembly of claim 5, wherein the second connector interfaces with a karaoke system.

7. The three-way cable assembly of claim 1, wherein the intermediate audio cable is terminated with direct connections to a karaoke system.

8. A three-way cable assembly comprising:

a 3.5 mm phone plug for connecting to an audio/video source, the 3.5 mm phone plug having contacts for left-audio, right-audio, video and ground;

an input cable interfaced at one end to the 3.5 mm phone plug, the input cable having a left audio input conductor connected to the 3.5 mm phone plug left-audio, a right audio input conductor connected to the 3.5 mm phone plug right-audio, a video input conductor connected to the 3.5 mm phone plug video and an input ground conductor connected to the 3.5 mm phone plug ground;

an intermediate audio cable having a first left audio intermediate conductor, a first right audio intermediate conductor, a second left audio intermediate conductor and a second right audio intermediate conductor and an intermediate ground conductor, the first left audio intermediate conductor connected to the left audio input conductor of the input cable and the first right audio intermediate conductor connected to the right audio input conductor of the input cable, the intermediate ground conductor connected to the input ground conductor of the input cable; and an output cable having a left output audio conductor, a right output audio conductor, an video output conductor and an output ground conductor, the left audio output conductor connected to the second left audio intermediate conductor of the intermediate connector, the right audio output conductor connected to the second right audio intermediate conductor of the intermediate connector, the video output conductor connected to the video input conductor, and the output ground conductor connected to the input ground conductor and connected to the intermediate ground conductor.

9. The three-way cable assembly of claim 8, wherein the input cable, intermediate cable and output cable meet at a cable head.

10. The three-way cable assembly of claim 8, further comprising a left RCA phono plug electrically and physically interfaced with the left audio output conductor and the output ground conductor of the output cable; a right RCA phono plug electrically and physically interfaced with the right audio output conductor and the output ground conductor of the output cable; and a video RCA phono plug electrically and physically interfaced with the video output conductor and the output ground conductor of the output cable.

11. The three-way cable assembly of claim 8, wherein the first left and right audio intermediate conductors and the second left and right audio intermediate conductors and the intermediate ground of the intermediate audio cable are terminated with a connector.

12. The three-way cable assembly of claim 11, wherein the connector interfaces with a karaoke system.

13. The three-way cable assembly of claim 8, wherein the first left and right audio intermediate conductors and the second left and right audio intermediate conductors and the intermediate ground conductor of the intermediate audio cable are directly connected to a karaoke device.

14. A three-way cable assembly comprising:

a means for connecting to an audio/video source;

an input cable having audio input conductors and a video input conductor connected at a first end to the means for connecting;

an intermediate audio cable having a first set of audio intermediate conductors and a second set of audio intermediate conductors, a first end of the first set of audio intermediate conductors connected to a second end of the audio input conductors of the input cable;

an output cable having audio output conductors and a video output conductor, a second end of the audio output conductors connected to a first end of the second set of audio intermediate conductors of the intermediate audio cable, a second end of the video output conductor connected to a second end of the video input conductor; and a means to physically join an end of the input cable, an end of the output cable and an end of the intermediate cable.

15. The three-way cable assembly of claim 14, wherein the means for connecting is a 3.5 mm phone plug with contacts for left-audio, right-audio, video and ground.

16. The three-way cable assembly of claim 14, further comprising a means for connecting the audio output conductors of the output cable to a television and a means for connecting the video output conductor of the output cable to a television.

17. The three-way cable assembly of claim 16, wherein the means for connecting the audio output conductors of the output cable are RCA phono plugs and the means for connecting the video output conductor of the output cable to a television is another RCA phono plug.

18. The three-way cable assembly of claim 14, wherein the intermediate audio cable is terminated by a means for connecting to a karaoke device.

19. The three-way cable assembly of claim 14, wherein the intermediate audio cable is terminated with direct connections to a karaoke system.

* * * * *